US009204728B2

(12) United States Patent
Panozzo et al.

(10) Patent No.: US 9,204,728 B2
(45) Date of Patent: Dec. 8, 2015

(54) SEAT ASSEMBLY FOR AN OFFICE CHAIR

(75) Inventors: Tony Panozzo, Zeeland, MI (US); Robert Meloche, Holland, MI (US)

(73) Assignee: HAWORTH, INC., Holland, MI (US)

( * ) Notice: Subject to any disclaimer, the term of this patent is extended or adjusted under 35 U.S.C. 154(b) by 518 days.

(21) Appl. No.: 13/643,108

(22) PCT Filed: Apr. 26, 2011

(86) PCT No.: PCT/US2011/033942

§ 371 (c)(1), (2), (4) Date: Jan. 21, 2013

(87) PCT Pub. No.: WO2011/137116

PCT Pub. Date: Nov. 3, 2011

(65) Prior Publication Data

US 2013/0119744 A1 May 16, 2013

Related U.S. Application Data

(60) Provisional application No. 61/343,265, filed on Apr. 26, 2010.

(51) Int. Cl.

| | |
|---|---|
| ***A47C 7/24*** | (2006.01) |
| ***A47C 7/16*** | (2006.01) |
| ***A47C 7/18*** | (2006.01) |

(52) U.S. Cl.

CPC ... *A47C 7/24* (2013.01); *A47C 7/16* (2013.01); *A47C 7/185* (2013.01)

(58) Field of Classification Search

CPC ..... A47C 31/11; A47C 7/40
USPC ..... 297/452.59, 452.58, 218.5, 218.3
See application file for complete search history.

(56) References Cited

U.S. PATENT DOCUMENTS

| | | | | |
|---|---|---|---|---|
| 5,015,034 | A * | 5/1991 | Kindig et al. | 297/227 |
| 5,121,963 | A * | 6/1992 | Kwasnik et al. | 297/227 |
| 5,478,134 | A * | 12/1995 | Bernard et al. | 297/218.1 |
| 6,378,944 | B1 * | 4/2002 | Weisser | 297/440.11 |
| 6,935,698 | B1 * | 8/2005 | Chen | 297/440.22 |
| 6,942,300 | B2 * | 9/2005 | Numa et al. | 297/452.56 |
| 6,983,997 | B2 * | 1/2006 | Wilkerson et al. | 297/452.56 |
| 7,040,834 | B2 * | 5/2006 | Nardi | 403/329 |
| 7,066,550 | B1 * | 6/2006 | Su | 297/440.22 |
| 2010/0176647 | A1 * | 7/2010 | Brockschnieder et al. | 297/452.58 |

* cited by examiner

*Primary Examiner* — Matthew Ing
(74) *Attorney, Agent, or Firm* — Warner Norcross & Judd LLP

(57) ABSTRACT

An improved attachment structure is provided for securing a cover in overlying covering relation to a seat cushion. In the chair, the chair comprises a seat/back assembly having a seat assembly and back assembly which are supported upon a load-bearing base adapted for support upon a floor. The attachment structure provides an improved method of securing a cover about its peripheral edge to an outer and inner shell on a seat assembly, wherein cooperating ribs and channel sections form convolutions in the fabric edge and hold the fabric edge between the inner and outer shells.

19 Claims, 8 Drawing Sheets

FIG. 8
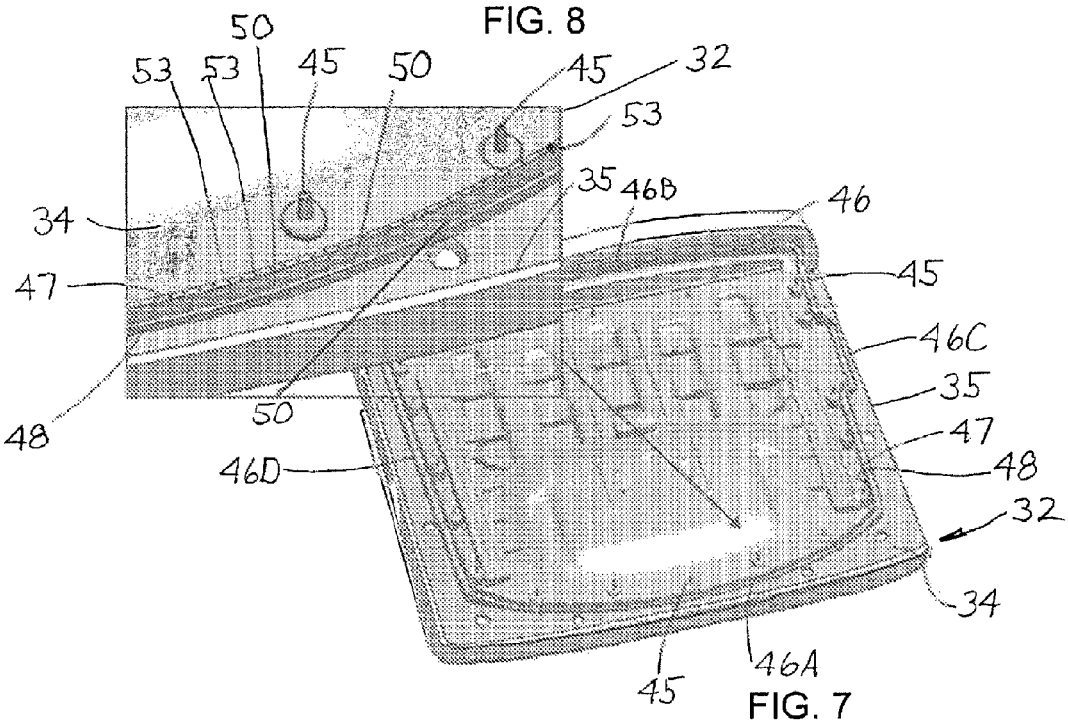
FIG. 7
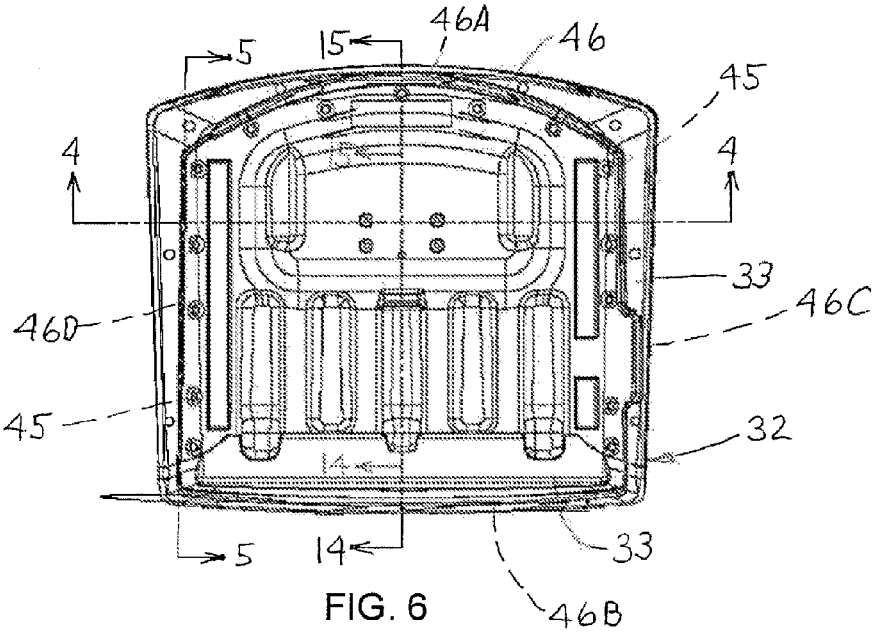
FIG. 6

SEAT ASSEMBLY FOR AN OFFICE CHAIR

FIELD OF THE INVENTION

The invention relates to an improved seat assembly, and more particularly, to a seat assembly having an improved connector structure for securing a cushion-enclosing cover to a seat shell.

BACKGROUND OF THE INVENTION

Conventional office chairs use a variety of constructions for the seat assembly. Many such chairs use a sheet-like molded shell which mounts to a chair base wherein the shell supports a cushion and then a seat cover which overlies the cushion to provide the aesthetic finished appearance of the seat assembly. The cover may be formed from a variety of materials and often is formed of a fabric that can be selectively varied depending upon the pattern desired by a purchaser. In such chairs, it is necessary to secure the peripheral edge of the cover, often to the seat shell or other seat structure. In some chair constructions, separate fasteners such as staples and the like may be used to secure the peripheral edge to the inner shell.

It is an object of the invention to provide an improved seat assembly for a cushioned seat having an improved construction for securing the peripheral edge of the seat cover.

The invention relates to improved attachment structure for securing a cover in overlying covering relation to a seat cushion. In the chair of the invention, the chair comprises a seat/back assembly having a seat assembly and back assembly which are supported upon a load-bearing base adapted for support upon a floor. This base may include a tilt control mechanism wherein the seat assembly and back assembly are pivotally connected to the tilt control mechanism and rearwardly reclinable in operation. The seat assembly itself has front and rear seat portions that pivotally connect to the tilt control mechanism supported on the base. To support the seat loads, the seat assembly comprises a structurally rigid support plate which is horizontally enlarged and formed of a structurally rigid material such as metal, wherein the front and rear edge portions of the seat plate pivotally connect to the seat or to the tilt control mechanism so that the seat assembly is rearwardly tiltable in operation.

The seat assembly further comprises a horizontally enlarged, inner shell which has a bottom surface which is supported by the seat plate, and an upper surface which preferably is covered with a resiliently-compressible cushion. This cushion extends outwardly to the outer peripheral edge of the inner shell and in turn is enclosed by a seat cover, for example, formed of a fabric material, which seat cover is enlarged widthwise and in the front-to-back direction so as to hang over the sides of the cushion and wrap about the outer peripheral edge of the inner shell. As such, the peripheral cover edge is able to wrap about and extend partially underneath the bottom of the inner shell. In this edge region, the inner shell includes an edgewise-extending securement channel defined by parallel, downwardly-projecting channel walls. The inner channel wall includes spaced-apart teeth which preferably are tapered so as to facilitate compression of the cover material.

An annular outer shell is provided which mounts to the inner shell from the underside thereof and extends about the outer periphery of the inner shell. This outer shell includes an upstanding rib that extends edgewise about the periphery of the outer shell and preferably is formed of aligned ribs which are separated from each other by cross-windows. In this manner, the individual ribs are edgewise elongate so as to be generally parallel to the inner and outer channel walls of the outer shell while the individual ribs may also have some cross-wise flexure. The free ends of the ribs include additional teeth so that when the outer shell is pressed or fitted onto the inner shell from below, the peripheral cover edge follows a convoluted or treacherous path by wrapping about the outer edge of the inner shell and overlapping the underside of the inner shell, and then turning upwardly into the channel or valley as it wraps over the free ends of the ribs, and then turns downwardly out of the channel and finally extends over and terminates beyond the inner channel wall and the teeth thereof.

As the fabric passes cross-wise through this convoluted path, the cover is pinched at pinch points, wherein one pinch point preferably is located between the teeth at the upper ends of the ribs and the opposing bottom surface of the valley, and a further pinch point is located at the teeth on the inner channel wall which presses the fabric against an opposing inside surface of the outer shell. Hence, the cover material is pinched at multiple locations along the cross-wise extend of the convoluted path and thereby fixedly secured at the edge of the cover in compressed, pinched engagement between opposing surfaces of the outer shell and inner shell.

Additionally, the individual ribs are separated edge-wise by the cross-windows wherein the interior of the securement channel also includes upstanding cross-ribs which extend between the inner and outer channel walls in crosswise relation and fit into the cross-windows which thereby forces the soft cover material into the cross-windows and defines additional folds along the convoluted path of the cover material. This provides additional fixed securement of the cover when compressed between the outer shell and inner shell.

To potentially define an additional pinch point, the separation of the individual ribs from each other by the cross-windows preferably allows for outward flexing of the individual ribs when the cover material is pulled taut on the seat. Sufficient cross-wise deflection of the ribs will occur until the outer side surface of each rib contacts the interior face of the outer channel wall which thereby would serve to define an additional pinch point by pinching the cover material sidewardly or cross-wise between the rib and the outer channel wall.

The securement structure provides an improved method of securing a cover about its peripheral edge to an outer and inner shell on a seat assembly. While this structure is primarily provided for a seat assembly, a back assembly might also be configured using such securing structure.

Other objects and purposes of the invention, and variations thereof, will be apparent upon reading the following specification and inspecting the accompanying drawings.

BRIEF DESCRIPTION OF THE DRAWINGS

FIG. 6 is a plan view of a shell assembly.

FIG. 7 is a bottom view of an inner shell of the shell assembly.

FIG. 8 is an enlarged partial view of the inner shell.

Figure 1:
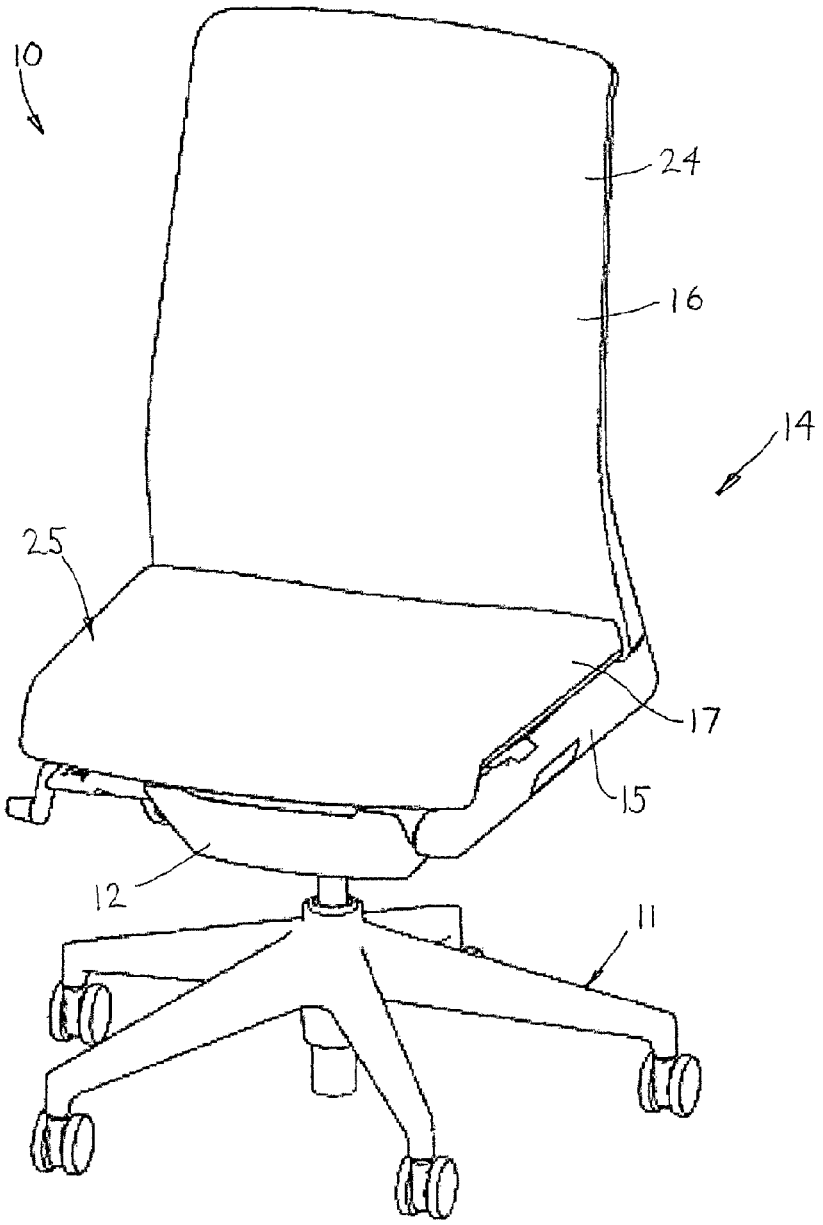
FIG. 1 is a perspective view of a chair of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
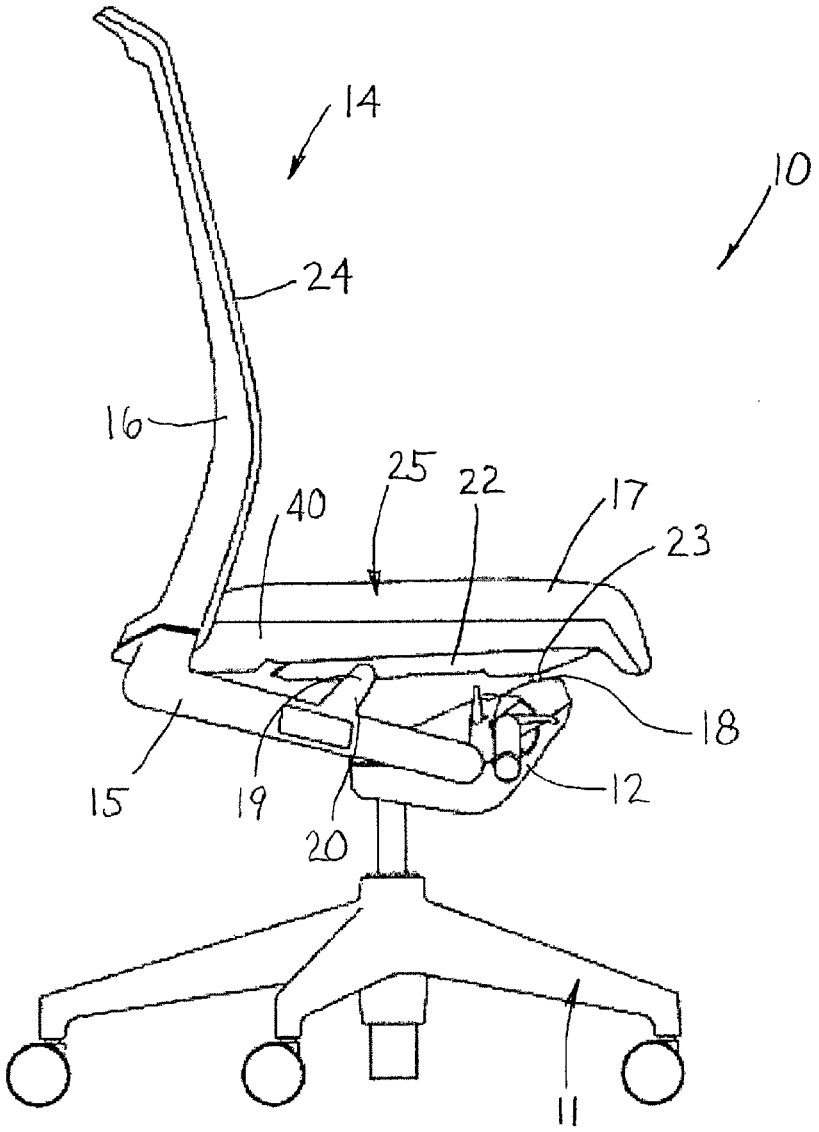
FIG. 2 is a side elevational view thereof.

Referring to FIGS. 1 and 2, the invention relates to a chair 10 having a pedestal base 11 which comprises a tilt control mechanism 12 having a seat/back assembly 14 pivotally connected thereto. The seat/back assembly 14 comprises a pair of uprights or support arms 15 which are pivotally connected at their front ends to the tilt control mechanism 12, and have rearward ends which support a back assembly 16 projecting vertically upwardly therefrom. Additionally, the seat/back assembly 14 includes a seat assembly 17 that is pivotally connected to the uprights 15 and the tilt control mechanism 12 so that the back assembly 16 and seat assembly 17 are rearwardly tiltable. The invention relates to improvements in the seat assembly 17.

Figure 3:
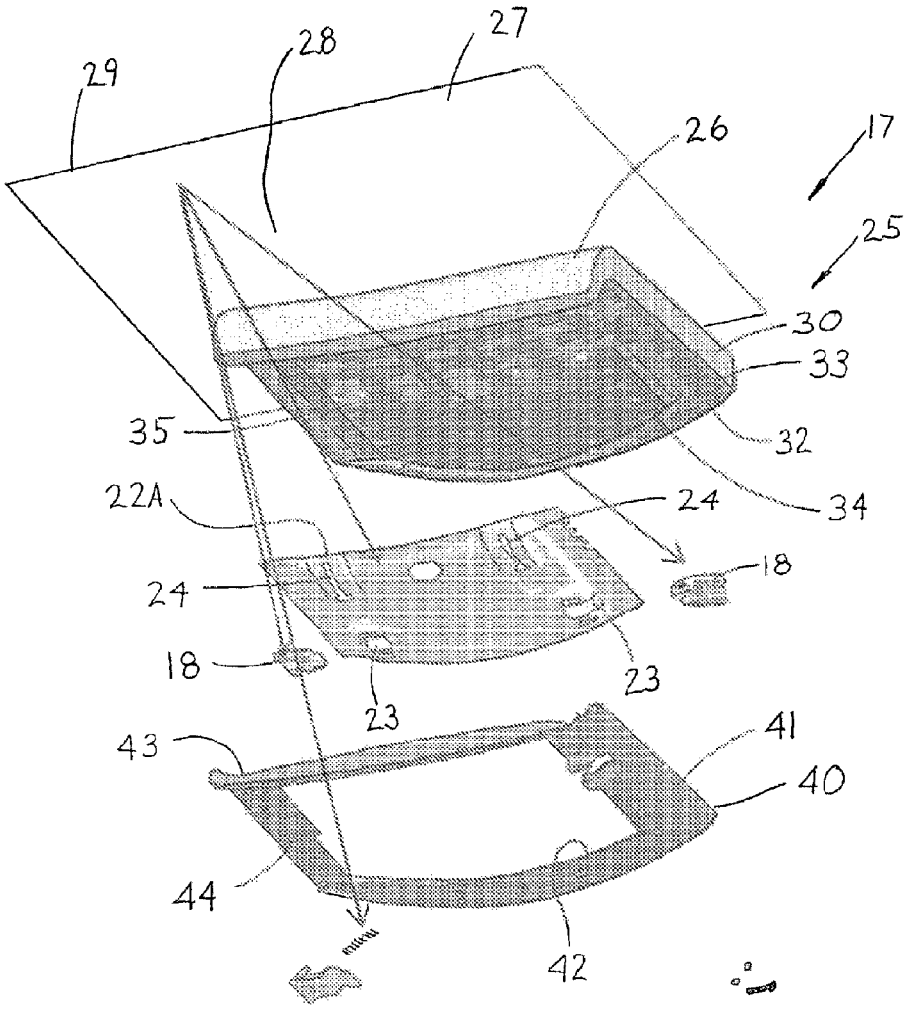
FIG. 3 is an exploded view of the seat assembly.

Referring to FIGS. 2 and 3, the seat assembly 17 is pivotally connected by its four corners to front pivot connections 18 to the tilt control mechanism 12, and rear pivot connections 19 at the upper ends of upwardly extending support arms 20 (FIG. 2) respectively provided on the uprights 15. In particular, the seat assembly 17 comprises a horizontally enlarged rigid support plate 22 which is formed of a rigid metal construction and has rear pivot mounts 23 which interconnect to the rear pivot connectors 19 (FIG. 2). The seat plate 22 also includes guide slots 24 which interconnect with the slidable pivot connectors 18 so that the front edge of the seat assembly 17 may displace rearwardly to a small extent therewith during rearward tilting of the uprights 15. The support plate 22 has a generally rectangular, pan-like shape which provides a rigid support surface 22A on the top thereof for carrying the loads of an occupant sitting on the seat assembly 17.

In the chair 10 of the invention, the back assembly 16 preferably includes a thin, suspension membrane 24 that supports the back of a chair occupant. The seat assembly 17 has a different construction in that the seat assembly 17 includes a seat cushion 25 that is relatively thick and is compressible to conform to the contours of the chair occupant.

Referring to FIG. 3, this cushion 25 generally comprises an interior cushion layer 26 and a sheet-like flexible cover 27 that preferably is formed of a fabric material that defines a suitable exposed surface of the seat assembly 17. The cover 27 is generally illustrated in FIG. 3 and is shaped so as to overlie the cushion. This cover 27 comprises a central portion 28 and a peripheral cover edge 29 that is configured to extend over the peripheral cushion edge 30 of the cushion layer 26. The peripheral cover edge 29 is configured to be fixedly secured to the seat assembly 17 in an improved manner which represents an inventive advantage over prior securement methods for fabric covers of this type.

More particularly, the seat assembly 17 comprises a horizontally enlarged inner shell 32 having a top surface 33 that is substantially covered by the cushion layer 26. The inner shell 32 further defines a downward-facing bottom surface 34 which is configured to fit onto the support plate 22 and is supported by such support plate 22 in the central region thereof. The inner shell 32 further defines an outer peripheral shell edge 35 which generally conforms to the peripheral cushion edge 30 in its shape. The size of the cover 27 is oversized relative to the edges 30 and 35 so that the peripheral edge portion 29 of the cover 27 is able to wrap about and extend beneath the bottom shell surface 34 for subsequent connection thereto.

In this regard, the seat assembly 17 further comprises a ring-like outer shell 40 which is defined by an outer shell edge 41, an inner shell edge 42 as well as top and bottom surfaces 43 and 44. The outer shell edge 41 is shaped and sized so that it conforms closely to the shape and size of the cushion edge 30 and inner shell edge 34. The interior shell edge 42 of the outer shell 40, however, is dimensioned larger than the support plate 22 so that this interior shell edge 42 is spaced outwardly of the support plate 22 and the support plate 22 in turn is able to pivotally connect to the tilt control mechanism 12 and uprights 15 as described above.

Figure 4:
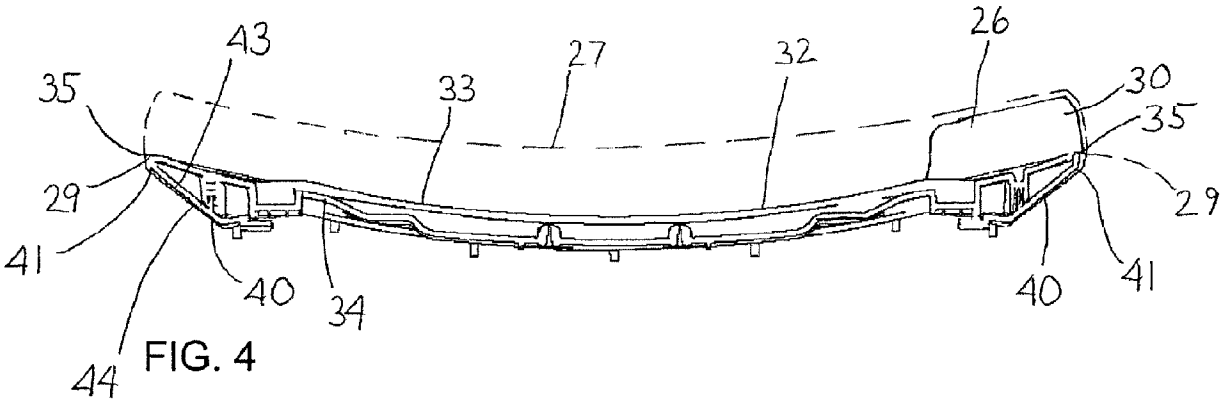
FIG. 4 is a front cross-sectional view of the joined shells.
Figure 5:
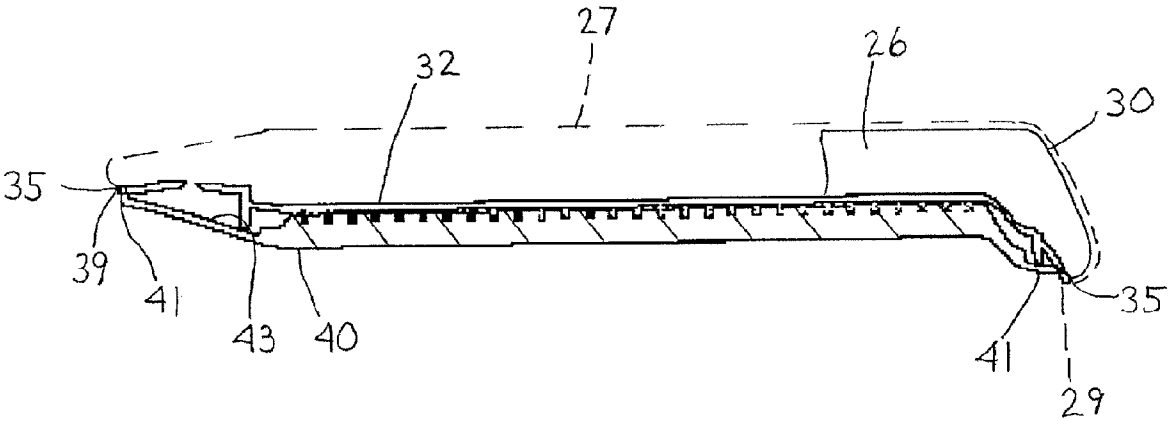
FIG. 5 is a side cross-sectional view thereof.
Figures 9, 10:
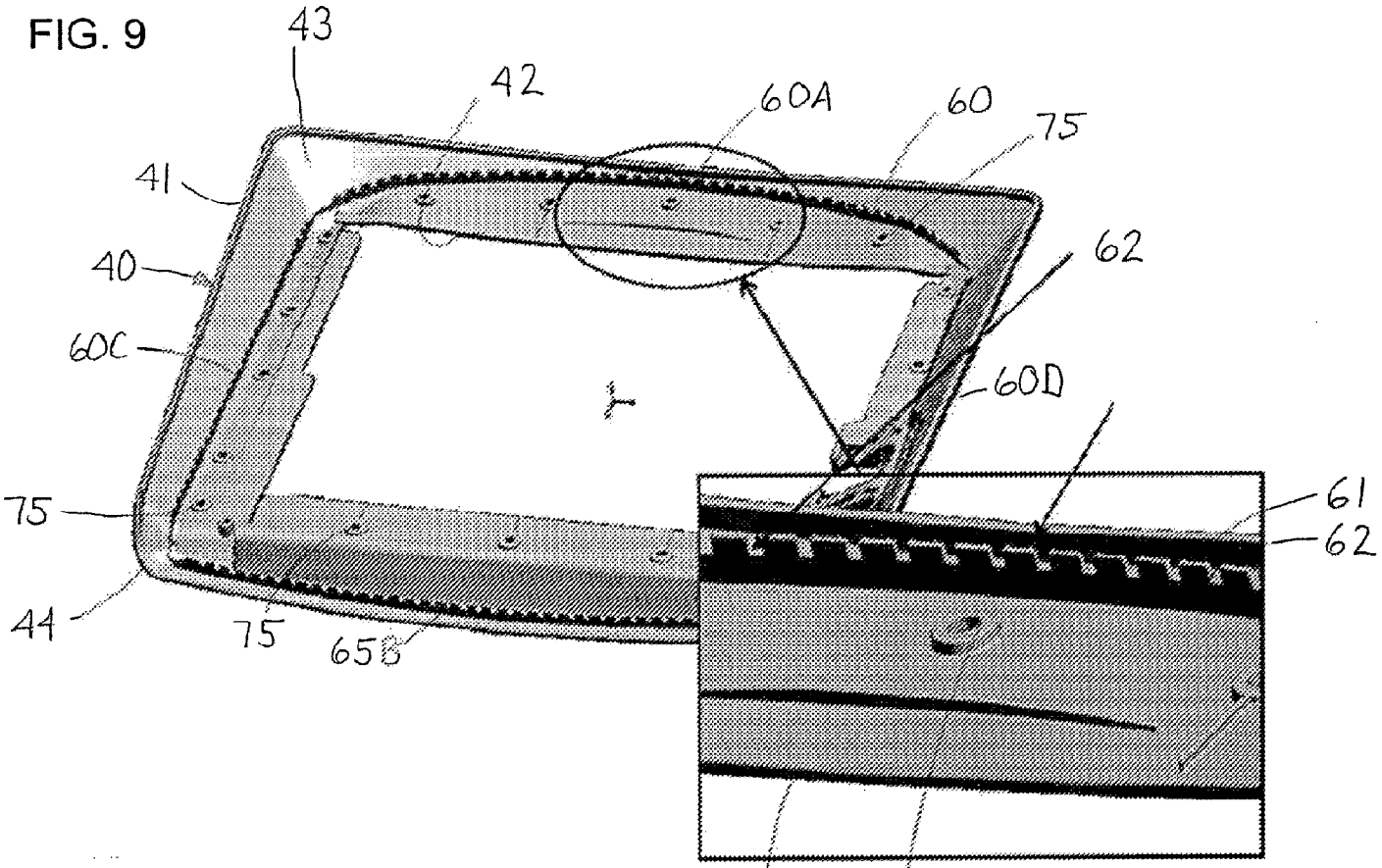
FIG. 9 is a top perspective view of an outer shell.
FIG. 10 is an enlarged partial view of the inner and outer shells.

Referring to FIGS. 4 and 5, the inner shell 32 includes the cushion layer 30 thereon as diagrammatically illustrated, and also includes the cover 27 which overlies the cushion material 30 and has its peripheral edge 29 wrapped downwardly around the outer shell edge 35 so as to thereby extend underneath the bottom shell surface 34 and be sandwiched between the inner shell 32 and the underlying outer shell 40 which is fitted below the bottom shell surface 34. In particular, the outer shell edge 41 is disposed so as to be closely adjacent and contact the outer shell edge 35 so that the peripheral cover edge 29 can extend into the space and be completely hidden from the exterior of the chair 10 which provides a clean appearance to the overall seat construction.

In this regard, it is necessary to ensure that the peripheral cover edge 29 is not able to pull free from the inner shell 32. In this regard, the peripheral cover edge 29 extends into the space between the inner shell 32 and outer shell 40 and extends along a torturous or convoluted path which securely engages the cover edge 29 so as to be compressed at one or more locations along such convoluted path to resist slippage of the cover edge 29 from the interface between the inner shell 32 and outer shell 40. Further, as will be described in further detail hereinafter, the tortuous or convoluted path as defined by the inventive connector structure forms convolutions in both a crosswise direction of the cover edge 29 which can extend either widthwise across the lateral width or front to back width of the fabric, or edgewise along the edgewise-extending cover edge 29. By forming convolutions in the crosswise and edgewise directions, the connection provides a strong interconnection with the cover edge 29 to prevent pulling separation of the cover 27 from the interface between the inner shell 32 and outer shell 40.

As to the outer shell shown in FIGS. 6-8, this outer shell 32 is adapted to receive the outer shell 40 in facing relation on the underside 34 thereof. In this regard, the bottom shell side 34 includes upstanding connector posts 45 at spaced-apart locations about the outer shell edge 35 for fastening to the outer shell 40. The inner shell 32 further comprises an edgewise-extending connector channel or valley 46 which is defined by front and back channel sections 46A and 46B as well as opposite side sections 46C and 46D. These channel sections 46A-46D generally have similar constructions although the overall shape may vary depending upon the requirements and components provided in the seat assembly 17. As seen in the enlarged view of FIGS. 8 and 13, the connector channel 46 is defined by inner and outer channel walls 47 and 48 and a bottom wall 49. The channel 46 is continuous along the length of the entire channel 46 at least proximate the downward-opening mouth of the channel 46. The bottom of the channel 46, however, which is defined adjacent the bottom wall 49, is segmented by cross-ribs 50 as seen generally in FIG. 8, and illustrated in greater detail in FIGS. 11-13. This forms a plurality of separated pockets 51 which are separated from each other by the cross-ribs 50. The pockets 51 hereby are defined edgewise by the spaced-apart cross-ribs 50, as well as crosswise by the inside faces of the inner and outer channel walls 47 and 48. These pockets 51 and cross-ribs 50 help define the convoluted path and the convolutions thereof in the crosswise direction and the edgewise direction. Since the channel 46 extends about the entire periphery of the inner shell 35, the crosswise direction extends between the inside faces of the inner and outer channel walls 47 and 48. As such, the crosswise direction in channel sections 46D and 46C would extend widthwise, while the crosswise direction in the channel sections 46A and 46B would extend in the front-to-back directions.

Figure 13:
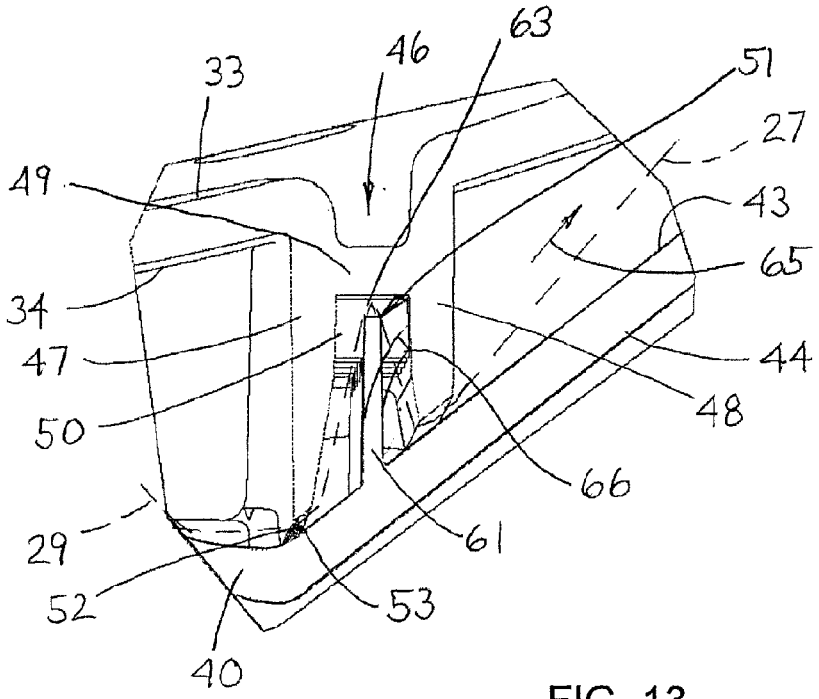
FIG. 13 is an enlarged perspective view of the joined inner and outer shells taken from the front.
Figure 14:
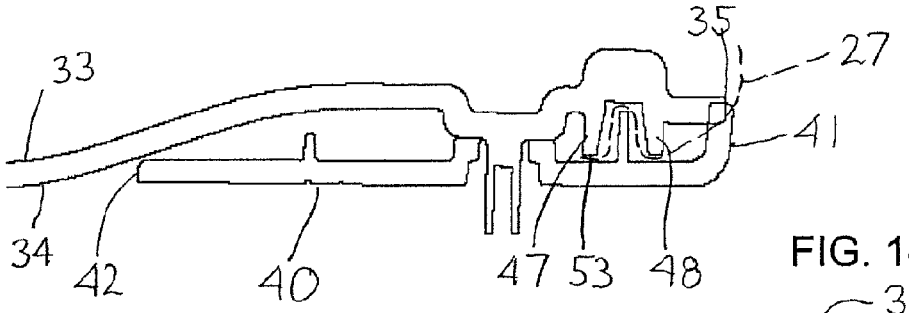
FIG. 14 is a partial side cross-sectional view taken at a rear of the chair.
Figure 15:
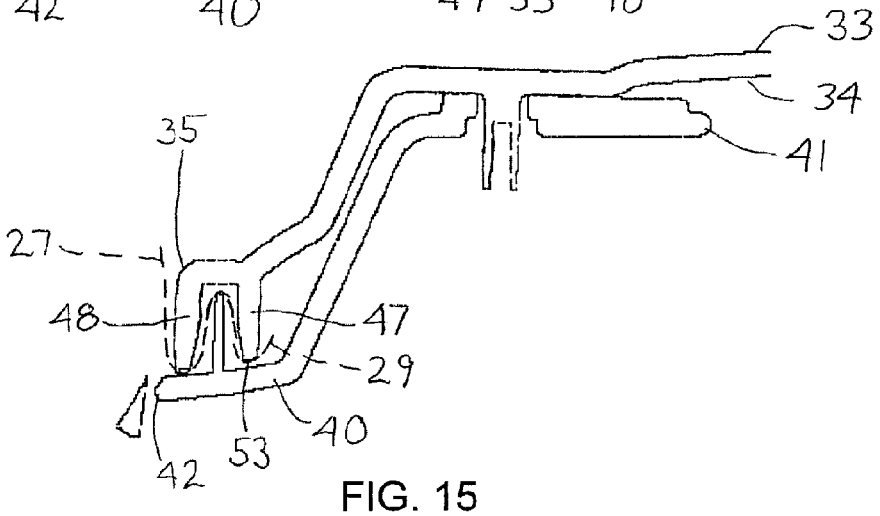
FIG. 15 is a side cross-sectional view taken at the front of the chair.

To further affix the cover edge 29, the middle edge 52 of the inner channel wall 47 is formed with a plurality of edgewise spaced projections or teeth 53 that preferably are formed as pointed or cone-shaped projections. As seen in FIGS. 13-15, the cover edge 29 extends over the wall edge 52 and is pinched by the projections 53 which project downwardly and are disposed closely adjacent if not disposed in contact with the inner face of the outer shell 40.

Figure 11:
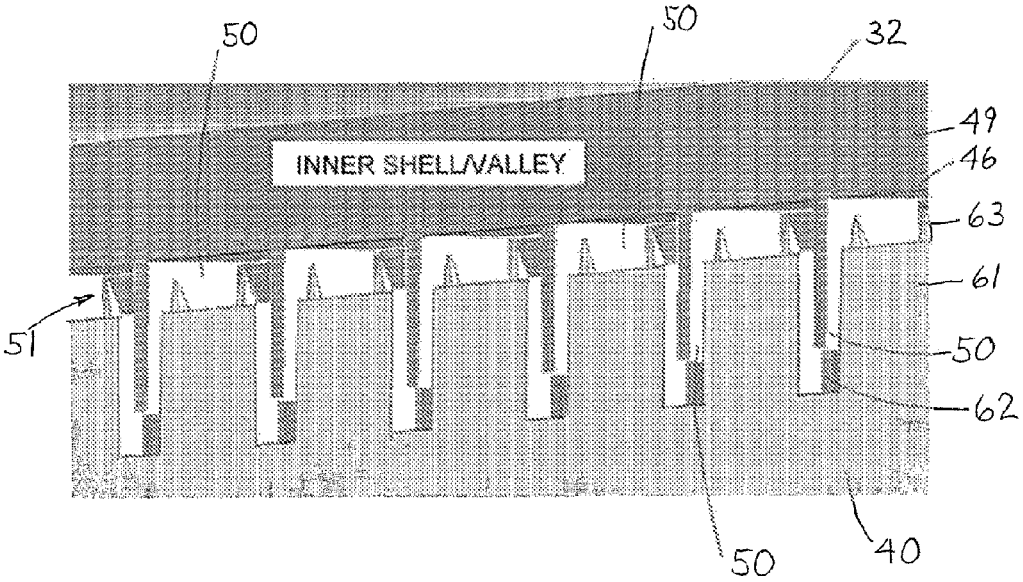
FIG. 11 is a side cross-sectional view of the joined shells.
Figure 12:
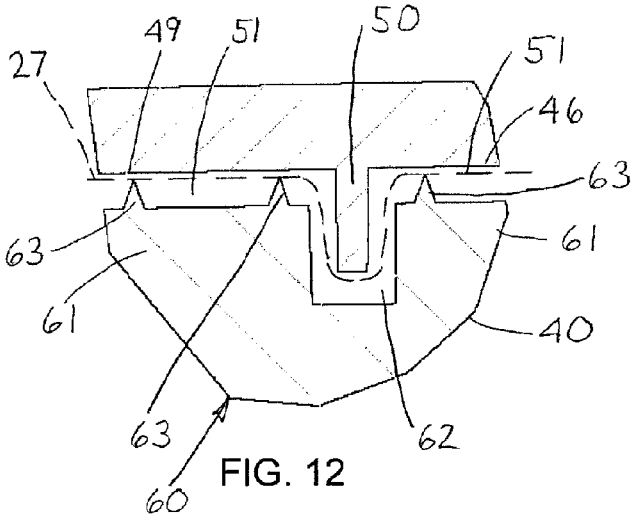
FIG. 12 is a side cross-sectional view thereof.

More particularly as to the outer shell 40, such shell 40 is formed with a peripheral rib structure 60 defined by front and rear rib sections 60A and 608 and side rib sections 60C and 60D. These rib sections 60A-60D of the rib structure 60 are each defined by separated, rectangular ribs 61 which project upwardly and are separated from each other by windows 62. FIGS. 11 and 12 clearly illustrate the individual ribs 61 and window 62 wherein the ribs 61 fit into the individual pockets 51 while the windows 62 accommodate the cross-ribs 50 described above. The individual ribs 60 also include upright conical or pointed teeth or projections 63, which project upwardly and are disposed closely adjacent the bottom channel surface defined by the bottom channel wall 49. These teeth 63 thereby pinch the cover 27 tightly against the channel bottom wall 49 while the inward section of the cover 27 also is pinched by the respective teeth 53 formed on the inner channel 47 as seen in FIG. 13. These structures thereby firmly secure the cover edge 29 in place.

In particular, the cover 27 follows a convoluted path in both the edgewise direction as seen in phantom outline in FIG. 12 and also follows a convoluted path in the crosswise direction as seen in phantom outline in FIG. 13. These paths extend sidewardly but then turn vertically downwardly or upwardly and then reverse directions and turn in the opposite downward or upward direction until then again turning sidewardly or horizontally. In the edgewise direction, the convoluted path is generally U-shaped (FIG. 12) as the cover 27 extends through each window 62 and around the bottom edge of the cross-ribs 50. In FIG. 13, the convoluted path defines an inverted U shape as the fabric 27 extends upwardly over the top edge and teeth 63 provided on the ends of the ribs 61. The crosswise convoluted path is also seen in FIG. 14 at the rear edge of the seat assembly 17, and in FIG. 15 at the front edge of the seat assembly 17. The edgewise convoluted path of FIG. 12 is also created at the seat back edge (FIG. 14) and at the seat front edge (FIG. 15).

Additionally, the close engagement of the respective teeth 53 and 63 against opposing shell surfaces creates pinch points at at least two locations along the crosswise width of the edge portion 29. When the seat assembly 17 is occupied, it is expected that this may thereby tension and pull the cover 27 outwardly in the direction of reference arrow 65 (FIG. 13) which would tend to attempt to withdraw the fabric edge 29 from the above-described connector structure. However, the above-described tortuous or convoluted path of the fabric edge 29 in the crosswise and edgewise directions will prevent undesirable stretching of the cover 27 away from this connector structure. If some stretching or displacement of the fabric 27 does occur, it is anticipated that the ribs 61 may also deflect inwardly as diagrammatically seen in FIG. 13 until the upper edge of the rib 61 contacts the inside face of the inner channel wall 48. This is then expected to create a further pinch point at location 66 and the pinching force would increase in direct relation to the pulling force by which the cover 27 is subjected by occupant loads. In this manner, the above-described connector structure provides secure engagement of the cover 27 within the interface between the inner shell 32 and the outer shell 40.

During assembly, the outer cover 40 also includes fastener holes 75 that align with the afore-mentioned posts 45 on the inner shell 32 so that the inner shell 32 and outer shell 40 are screwed together and tightly secure the fabric edge 29 as described above. This then forms a sub-assembly of the shells 32 and 40, the cushion layer 30 and the cover 27 which in turn can be mounted to the support plate 22 by appropriate fasteners.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair comprising:

a seat/back assembly which includes a cushion assembly for supporting one of a seat and back of a chair occupant, said cushion assembly including a cushion, a cover and an attachment structure for securing said cover in overlying covering relation to said cushion;

said cushion assembly further comprising a horizontally enlarged, inner shell which has a bottom surface and an upper surface which is covered with said cushion, said cushion being resiliently-compressible, and extending outwardly to an outer peripheral shell edge of the inner shell, said cushion being enclosed by said cover which said cover is enlarged widthwise and in the front-to-back direction so as to hang over the sides of the cushion and wrap about the outer peripheral shell edge of the inner shell, wherein a peripheral cover edge of the cover is able to wrap about and extend partially underneath the bottom surface of the inner shell, said inner shell in the edge region of the outer peripheral shell edge including an edgewise-extending securement channel defined by parallel, downwardly-projecting inner and outer channel walls, wherein said inner channel wall includes spaced-apart first teeth for securing said cover;

said cushion assembly further including an outer shell which mounts to the inner shell from the bottom surface thereof and extends along the outer peripheral shell edge, said outer shell including said attachment structure thereon which comprises an upstanding rib that extends edgewise about an outer periphery of the outer shell, a free end of said rib including spaced-apart second teeth so that when said outer shell is fitted onto the inner shell, the peripheral cover edge follows a convoluted path by wrapping about the outer peripheral shell edge of the inner shell and overlapping the bottom surface of the inner shell, and then turning into the securement channel as it wraps over the free end of the rib, and then turns downwardly out of the securement channel and finally extends over and terminates beyond the inner channel wall and the first teeth thereof; and wherein said cover is pinched at first and second pinch points as said cover passes cross-wise through said convoluted path, wherein said second pinch point is located between the second teeth at the upper end of the rib and the opposing bottom surface of the securement channel, and said first pinch point is located at the first teeth on the inner channel wall which presses the cover against an opposing inside surface of the outer shell.

2. The chair according to claim 1, wherein said rib is separated edge-wise by the cross-windows to define separated rib sections.

3. The chair according to claim 2, wherein said separation of the rib sections from each other by the cross-windows allows for outward flexing of the rib sections when the cover is pulled taut on the cushion assembly.

4. The chair according to claim 2, wherein an interior of the securement channel also includes upstanding cross-ribs which extend between the inner and outer channel walls in crosswise relation and fit into the cross-windows which secures the cover within the cross-windows and defines additional folds along the convoluted path of the cover.

5. The chair according to claim 1, wherein said first and second teeth are tapered so as to facilitate compression of the cover.

6. The chair according to claim 1, wherein said rib is formed of aligned rib sections which are separated from each other by cross-windows, said rib sections being edgewise elongate so as to be parallel to the inner and outer channel walls of the inner shell.

7. The chair according to claim 6, wherein an interior of the securement channel also includes upstanding cross-ribs which extend between the inner and outer channel walls in crosswise relation and fit into the cross-windows which secures the cover within the cross-windows and defines additional folds along the convoluted path of the cover, said cover being pinched at multiple locations along the cross-wise extent of the convoluted path and fixedly secured at the peripheral edge of the cover in compressed, pinched engagement between opposing surfaces of the outer shell and inner shell.

8. A chair comprising:

a seat/back assembly which includes a cushion assembly for supporting one of a seat and back of a chair occupant, said cushion assembly including a cushion, a cover and an attachment structure for securing said cover in overlying covering relation to said cushion;

said cushion assembly further comprising a horizontally enlarged, inner shell which has a bottom surface and an upper surface which is covered with said cushion, said cushion being resiliently-compressible, and extending outwardly to an outer peripheral shell edge of the inner shell, said cushion being enclosed by said cover which said cover is enlarged widthwise and in the front-to-back direction so as to hang over the sides of the cushion and wrap about the outer peripheral shell edge of the inner shell, wherein a peripheral cover edge of the cover is able to wrap about and extend partially underneath the bottom surface of the inner shell, said inner shell in the edge region of the outer peripheral shell edge including an edgewise-extending securement channel defined by parallel, downwardly-projecting inner and outer channel walls;

said cushion assembly further including an outer shell which mounts to the inner shell from the bottom surface thereof and extends along the outer peripheral shell edge, said outer shell including said attachment structure thereon which comprises an upstanding rib that extends edgewise about an outer periphery of the outer shell, the peripheral cover edge follows a convoluted path by wrapping about the outer peripheral shell edge of the inner shell and overlapping the bottom surface of the inner shell, and then turning into the securement channel as it wraps over the free end of the rib, and then turns downwardly out of the securement channel and finally extends over and terminates beyond the inner channel wall and the first teeth thereof, said cover being pinched at multiple locations along the cross-wise extent of the convoluted path and being fixedly secured at the edge of the cover in compressed, pinched engagement between opposing surfaces of the outer shell and inner shell.

9. The chair according to claim 8, wherein said cover is pinched at first and second pinch points as said cover passes cross-wise through said convoluted path, wherein said second pinch point is located between the upper end of the rib and the opposing bottom surface of the securement channel, and said first pinch point is located at a terminal end of the inner channel wall which presses the cover against an opposing inside surface of the outer shell.

10. The chair according to claim 9, wherein said free end of said rib includes spaced-apart second teeth to define said second pinch point, and said terminal end of said inner channel wall includes spaced-apart first teeth to define said first pinch point.

11. The chair according to claim 8, wherein said cushion assembly is supported upon a load-bearing base adapted for support upon a floor.

12. The chair according to claim 11, wherein said base includes a tilt control mechanism wherein the seat assembly and back assembly are pivotally connected to the tilt control mechanism and rearwardly reclinable in operation.

13. The chair according to claim 8, wherein said rib is formed of aligned rib sections which are separated from each other by cross-windows, said rib sections being edgewise elongate so as to be parallel to the inner and outer channel walls of the inner shell.

14. The chair according to claim 13, wherein an interior of the securement channel also includes upstanding cross-ribs which extend between the inner and outer channel walls in crosswise relation and fit into the cross-windows which secures the cover within the cross-windows and defines additional folds along the convoluted path of the cover, said cover being pinched at multiple locations along the cross-wise extent of the convoluted path and fixedly secured at the peripheral edge of the cover in compressed, pinched engagement between opposing surfaces of the outer shell and inner shell.

15. A chair comprising:

a seat/back assembly which includes a cushion assembly for supporting one of a seat and back of a chair occupant, said cushion assembly including a cushion, a cover and an attachment structure for securing said cover in overlying covering relation to said cushion;

said cushion assembly further comprising a horizontally enlarged, inner shell which has a bottom surface and an upper surface which is covered with said cushion, said cushion being resiliently-compressible, and extending outwardly to an outer peripheral shell edge of the inner shell, said cushion being enclosed by said cover which said cover is enlarged widthwise and in the front-to-back direction so as to hang over the sides of the cushion and wrap about the outer peripheral shell edge of the inner shell, wherein a peripheral cover edge of the cover is able to wrap about and extend partially underneath the bottom surface of the inner shell, said inner shell in the edge region of the outer peripheral shell edge including an edgewise-extending securement channel defined by parallel, downwardly-projecting inner and outer channel walls;

said cushion assembly further including an outer shell which mounts to the inner shell from the bottom surface thereof and extends along the outer peripheral shell edge, said outer shell including said attachment structure thereon which comprises an upstanding rib that extends edgewise about an outer periphery of the outer shell, a free end of said rib including spaced-apart second teeth so that when said outer shell is fitted onto the inner shell, the peripheral cover edge follows a convoluted path by wrapping about the outer peripheral shell edge of the inner shell and overlapping the bottom surface of the inner shell, and then turning into the securement channel as it wraps over the free end of the rib, and then turns downwardly out of the securement channel and finally extends over and terminates beyond the inner channel wall and the first teeth thereof, said cover being pinched at multiple locations along the cross-wise extent of the convoluted path and being fixedly secured at the edge of the cover in compressed, pinched engagement between opposing surfaces of the outer shell and inner shell, wherein said cover is pinched at first and second pinch points as said cover passes cross-wise through said convoluted path, wherein said second pinch point is located between the upper end of the rib and the opposing bottom surface of the securement channel, and said first pinch point is located at a terminal end of the inner channel wall which presses the cover against an opposing inside surface of the outer shell; and said rib being formed of aligned rib sections which are separated from each other by cross-windows, said rib sections being edgewise elongate so as to be parallel to the inner and outer channel walls of the inner shell.

16. The chair according to claim 15, wherein an interior of the securement channel also includes upstanding cross-ribs which extend between the inner and outer channel walls in crosswise relation and fit into the cross-windows which secures the cover within the cross-windows and defines additional folds along the convoluted path of the cover.

17. The chair according to claim 16, wherein said cushion assembly is supported upon a load-bearing base adapted for support upon a floor.

18. The chair according to claim 17, wherein said base includes a tilt control mechanism wherein the chair includes a seat assembly and back assembly which are pivotally connected to the tilt control mechanism and rearwardly reclinable in operation.

19. The chair according to claim 18, wherein said seat assembly has front and rear seat portions that pivotally connect to the tilt control mechanism supported on the base and wherein the front and rear edge portions of a support plate pivotally connect to the seat or to the tilt control mechanism and the support plate supports said inner shell.

* * * * *